US006448718B1

(12) United States Patent
Battersby

(10) Patent No.: US 6,448,718 B1
(45) Date of Patent: Sep. 10, 2002

(54) ACTIVE MATRIX ELECTROLUMINESCENT DISPLAY DEVICE

(75) Inventor: Stephen J. Battersby, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 2 days.

(21) Appl. No.: 09/691,814

(22) Filed: Oct. 19, 2000

(30) Foreign Application Priority Data

Oct. 23, 1999 (GB) ..... 9925060

(51) Int. Cl.[7] ..... G09G 3/10

(52) U.S. Cl. ..... 315/169.3; 315/169.1; 345/76; 345/82

(58) Field of Search ..... 315/169.1, 169.3, 315/169.4; 340/702; 345/76, 82, 205; 313/483–498

(56) References Cited

U.S. PATENT DOCUMENTS

| | | | | |
|---|---|---|---|---|
| 5,012,228 A | * | 4/1991 | Masuda et al. | 340/702 |
| 5,952,789 A | | 9/1999 | Stewart et al. | 315/169.4 |
| 5,990,629 A | * | 11/1999 | Yamada et al. | 315/169.3 |
| 6,064,158 A | * | 5/2000 | Kishita et al. | 315/169.3 |
| 6,175,345 B1 | * | 1/2001 | Kuribayashi et al. | 315/169.3 |
| 6,356,029 B1 | * | 3/2002 | Hunter | 315/169.1 |

FOREIGN PATENT DOCUMENTS

| | | | |
|---|---|---|---|
| EP | 0653741 A1 | 5/1995 | G09G/3/30 |
| EP | 0717446 A2 | 6/1996 | H01L/27/15 |
| WO | WO9636959 | 11/1996 | G09G/3/30 |

* cited by examiner

*Primary Examiner*—Don Wong
*Assistant Examiner*—Jimmy T. Vu

(57) ABSTRACT

An active matrix electroluminescent (EL) display device has an array of pixels (10) on a substrate (25) each comprising an EL display element (20) and a driving device (22) controlling drive current therethrough in a drive period based on a data signal applied in a preceding address period, and a drive circuit (16, 18) connected to the pixels via sets of address conductors (12, 14) for selecting the rows of pixels and supplying data signals to each selected row of pixels in a respective row address period. The data signals are provided by drive ICs (40). To reduce the number of ICs required, a multiplexing circuit (45) is integrated with the pixel array on the substrate (25) and connected between the drive IC outputs (41) and one set of address conductors (14) and is operable to apply data signals from an individual drive IC output to a respective associated plurality of address conductors in sequence in a row address period. The display elements of a selected row of pixels are prevented from operating in the row address period to avoid unwanted cross-talk effects. Row selection signals may similarly be supplied by a multiplexing circuit (16) integrated on the substrate.

20 Claims, 2 Drawing Sheets

ACTIVE MATRIX ELECTROLUMINESCENT DISPLAY DEVICE

BACKGROUND OF THE INVENTION

This invention relates to active matrix electroluminescent display devices comprising an array of electroluminescent display pixels.

Matrix display devices employing electroluminescent, light-emitting, display elements are well known. The display elements may comprise organic thin film electroluminescent elements, for example using polymer materials, or else light emitting diodes (LEDs) using traditional III–V semiconductor compounds. Recent developments in organic electroluminescent materials, particularly polymer materials, have demonstrated their ability to be used practically for video display devices. These materials typically comprise one or more layers of an electroluminescent material, for example a semiconducting conjugated polymer, sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer.

Organic electroluminescent materials exhibit diode-like I–V properties, so that they are capable of providing both a display function and a switching function, and can therefore be used in passive type displays.

However, the invention is concerned with active matrix display devices, with each pixel comprising a display element and a driving device for controlling the current through the display elements. Examples of an active matrix electroluminescent display are described in EP-A-0653741 and EP-A-0717446. Unlike active matrix liquid crystal display devices in which display elements are capacitive and therefore take virtually no current and allow a drive (data) signal voltage to be stored on the capacitance for the whole frame time electroluminescent display elements need to continuously pass current to generate light. A driving device of a pixel, usually comprising a TFT (thin film transistor), is responsible for controlling the current through the display element. The brightness of the display element is dependent to the current flowing through it. During an address period for a pixel, a drive (data) signal determining the required output from the display element is applied to the pixel and stored as a corresponding voltage on a storage capacitor which is connected to, and controls the operation of, the current controlling drive device with the voltage stored on the capacitor serving to maintain operation of the driving device in supplying current through the display element during the subsequent drive period, corresponding to a frame period, until the pixel is addressed again.

Typically, the pixels are connected to sets of row and column address conductors through which selection, (scanning), signals and analogue voltage data signals respectively are supplied by a peripheral drive circuit, each row of pixels being selected in turn in a respective row address period by means of a selection signal applied to its associated row conductor and with the data signals for the pixels of the selected row being applied via the column conductors. The data signals can be provided by a column driver circuit comprising silicon integrated circuits (IC) chips. Each chip has a limited number of individual, spaced, output contacts. Each column conductor is connected to a respective chip output and consequently a large number of chips would normally be required. For example, if there are 800 pixels in a row and a chip is capable of providing 100 outputs then 8 chips are needed to supply the 800 column conductors involved.

The electroluminescent display elements of all the pixels in a respective row, or column, are connected, through their associated drive devices to a common current line. The storage capacitors of the pixels are also connected to these common lines and such sharing of the current lines leads to a further problem in that voltage drops can occur along these lines in operation which has the effect of producing a kind of cross-talk.

BRIEF SUMMARY OF THE INVENTION

It is an object of the present invention to provide an improved active matrix electroluminescent display device.

According to the present invention there is provided an active matrix electroluminescent display device comprising a row and column array of pixels carried on a substrate, each pixel comprising an electroluminescent display element and a driving device for controlling current through the display element in a drive period based on a data signal applied in a preceding row address period, the display element being connected via the driving device to a current line common to a row of pixels, and a peripheral drive circuit connected to the pixel array which drive circuit generates and applies data signals to each row of pixels in respective row address periods via a set of address conductors connected to the array of pixels and comprises at least one drive IC having a plurality of outputs, which is characterised in that the at least one drive IC is connected to the set of address conductors through a multiplexing circuit which is integrated on the substrate and is operable to apply data signals from each output of the drive IC to a respective plurality of address conductors in the set in sequence in the row address period, and in that the drive circuit is arranged to prevent current flowing through the display elements of a row of pixels during its respective row address period.

Through the integration of a multiplexing circuit on the device substrate operable in this manner, considerable cost savings are possible as fewer drive ICs are required for a device having a given number of columns of pixels. With a multiplexing ratio of 4:1 for example, wherein each group of address conductors supplied by a respective drive IC output comprises four address conductors, the cost of the drive ICs needed is reduced by 75% in comparison to the case in which a single IC output is connected exclusively to a respective single address conductor. Using the same thin film fabrication technology employed for fabricating the pixels the integrated multiplexing circuit is provided at little or no additional expense and can be formed at the same time as the thin film elements of the pixels using common thin film layers and comprising similar thin film circuit elements such as TFTs and conductor lines. Multiplexing switches used in the multiplexing circuit are preferably of the same type as used in the pixel array, for example p or n type polysilicon TFTs. Consequently it is possible to produce the thin film circuitry on the device substrate forming the pixel array and the multiplexing circuit using standard thin film technology involving the deposition and patterning of various conductive, dielectric and semiconductive layers. With the pixel circuits and the integrated multiplexer circuit using the same type of switching device, e.g. either p or n channel polysilicon TFTs, fabrication of the array together with the multiplexing circuit is considerable simplified, typically requiring only 5 or 6 mask processes rather than 9 or 10 mask processes as normally required to produce both p and channel (CMOS) TFTs.

However, both p and n channel type TFTs could be used which would enable circuitry such as shift registers requiring CMOS circuits to be integrated as well on the device substrate. Shift registers could be used in the column drive circuit and/or in the row drive (selection) circuit. The benefits of using both p and n (CMOS) devices in allowing extended integration would need to be considered in relation to the more complicated (higher mask count) fabrication processes necessary.

The pixels of each row are addressed with their data signals in a respective row address period during which the multiplexing circuit operates to supply data signals in time division manner to the pixels of each group in the row in sequence. By preventing current flowing through the display elements during the period of their addressing then problems with cross-talk effect caused by voltage drops occurring in their shared current line due to inherent resistance are avoided. Such prevention can be accomplished by ensuring that the display elements are zero or reversed biased during the full, entire, row address period rather than merely the portion thereof in which individual pixels are addressed. To this end, the potential applied to the common current line may be switched or a switching device, e.g. another TFT, may be connected in series with the display element of each pixel that is operable to disconnect the display element from the current line for the duration of the row address period.

BRIEF DESCRIPTION OF THE SEVERAL VIEWS OF THE DRAWING

An embodiment of an active matrix electroluminescent display device in accordance with the present invention will now be described, by way of example, with reference to the accompanying drawings, in which.

The Figures are merely schematic. The same reference numbers are used throughout the Figures to denote the same or similar parts.

DETAILED DESCRIPTION OF THE INVENTION

Figure 1:
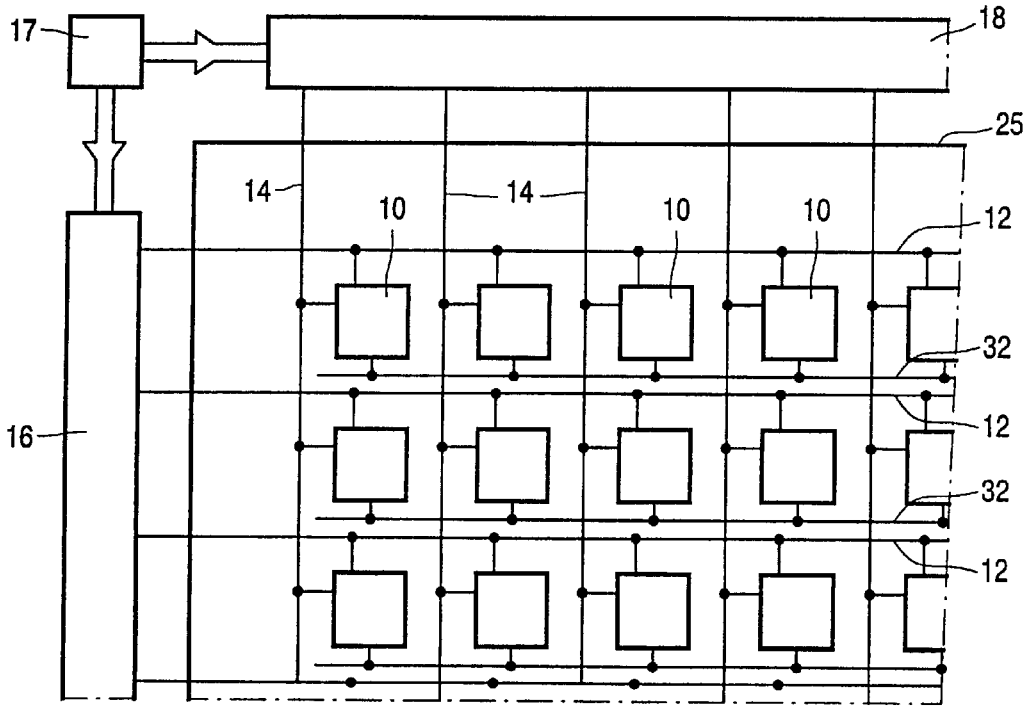
FIG. 1 PRIOR ART
FIG. 1 is a simplified schematic diagram of a known active matrix electroluminescent display device comprising an array of pixels.

Referring to FIG. 1, the active matrix electroluminescent display device comprises a panel having a row and column matrix array of regularly-spaced pixels, denoted by the blocks 10 carried on a substrate 25, each comprising an electroluminescent display element and an associated driving device controlling the current through the display element, and which are located at the intersections between crossing sets of row (selection) and column (data) address conductors, or lines, 12 and 14 also carried on the substrate. Only a few pixels are shown for simplicity. The pixels 10 are addressed via the sets of address conductors by a peripheral drive circuit having outputs connected to the panel and comprising a row, scanning, driver circuit 16 generating scanning signals supplied to the row conductors in sequence and a column, data, driver circuit 18 generating data signals supplied to the column conductors and defining the display outputs from the individual pixel display elements, and a timing and control unit 17 for controlling the operation of the circuits 16 and 18.

Each row of pixels is addressed in turn by means of a selection signal applied by the circuit 16 to the relevant row conductor 12 so as to load the pixels of the row with respective drive signals according to the respective data signals supplied in parallel by the circuit 18 to the column conductors. As each row is addressed, the data signals are supplied by the circuit 18 in appropriate synchronisation.

Figure 2:
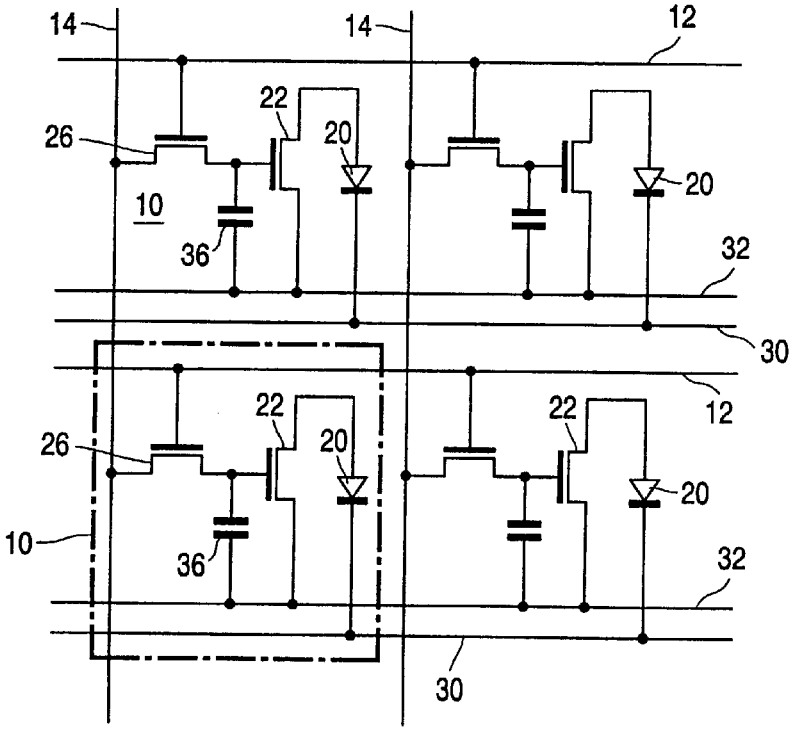
FIG. 2 PRIOR ART
FIG. 2 shows the equivalent circuit of a few typical pixels of the active matrix electroluminescent display device of FIG. 1.

FIG. 2 illustrates the circuit of a few, typical, pixels in this known device. Each pixel, 10, includes a light emitting organic electroluminescent display element 20, represented here as a diode element (LED), and comprising a pair of electrodes between which one or more active layers of organic electroluminescent material is sandwiched. In this particular embodiment the material comprises a polymer LED material, although other organic electroluminescent materials, such as low molecular weight materials, could be used. The display elements of the array are carried together with the associated active matrix circuitry on one side of the substrate. Either the cathodes or the anodes of the display elements are formed of transparent conductive material. The substrate is of transparent insulating such as glass and the electrodes of the individual display elements 20 closest to the substrate can consist of a transparent conductive material such as ITO so that light generated by the electroluminescent layer is transmitted through these electrodes and the substrate so as to be visible to a viewer at the other side of the substrate. Alternatively, the light output could be viewed from above the panel and the display element anodes in this case would comprise parts of a continuous ITO layer constituting a supply line common to all display elements in the array. The cathodes of the display elements comprise a metal having a low work-function such as calcium or magnesium silver alloy. Examples of suitable organic conjugated polymer materials which can be used are described in WO 96/36959. Examples of other, low molecular weight, organic materials are described in EP-A-0717446. The array of pixels and sets of address conductors are fabricated using standard thin film processing technology, similar to that used for AMLCDs, which involves the deposition and patterning of various conductive, insulating and semi-conductive layers. Examples of such fabrication are described in the aforementioned EP-A-0717446.

Each pixel 10 includes a drive device in the form of a TFT 22 which controls the operation of the display element 20 based on a data signal voltage applied to the pixel. The signal voltage for a pixel is supplied via a column conductor 14 which is shared between a respective column of pixels. The column conductor 14 is coupled to the gate of the current-controlling drive transistor 22 through an address TFT 26. The gates for the address TFTs 26 of a row of pixels are coupled together to a common row conductor 12.

Each row of pixels 10 also shares a common voltage supply line 30, usually provided as a continuous electrode common to all pixels, and a respective common current line 32. The display element 20 and the drive device 22 are connected in series between the voltage supply line 30 and the common current line 32, which is at a positive potential with respect to the supply line 30 and acts as a current drain for the current flowing through the display element 20. The level of current flowing through the display element is controlled by the switching device 22 and is a function of the gate voltage on the transistor 22, which is dependent upon a stored control signal determined by the data signal supplied to the column conductor 14.

A row of pixels is selected by the row driver circuit 16 applying a selection pulse to the row conductor 12 which switches on the address TFTs 26 for the respective row of pixels and whose duration determines the row address period. A voltage level (data signal) derived from the video information is applied to the column conductor 14 by the driver circuit 18 and is transferred by the address TFT 26 to the gate of the drive transistor 22. During the periods when a row of pixels is not being addressed via the row conductor 12 the address transistor 26 is turned off, but the voltage on the gate of the drive transistor 22 is maintained by a pixel storage capacitor 36 which is connected between the gate of the drive transistor 22 and the common current line 32 so as to maintain the operation of the display element during this subsequent drive period. The voltage between the gate of the drive transistor 22 and the common current line 32 determines the current passing through the display element 20 of the pixel 10. Thus, the current flowing through the display element is a function of the gate-source voltage of the drive transistor 22 (the source of the n-channel type transistor 22 being connected to the common current line 32, and the drain of the transistor 22 being connected to the display element 20). This current in turn controls the light output level (grey-scale) of the pixel.

The switching transistor 22 is arranged to operate in saturation, so that the gate-source voltage governs the current flowing through the transistor, irrespectively of the drain-source voltage. Consequently, slight variations of the drain voltage do not affect the current flowing through the display element 20. The voltage on the voltage supply line 30 is therefore not critical to the correct operation of the pixels.

Each row of pixels is addressed in turn in respective row address periods so as to load the pixels of each row in sequence with their drive signals and set the pixels to provide desired outputs for the subsequent drive (frame) period until they are next addressed.

The data signals are commonly supplied to the set of address conductors 14 by a plurality of external, silicon integrated circuit, drive circuit ICs each of which has a number of discrete output terminals that are each connected to a respective one of the conductors 14. Thus, each conductor 14 requires a respective exclusive, and dedicated, associated output terminal. If there are C conductors 14 in the set and each drive IC has n outputs, (and assuming C >>n). then C/n drive ICs are required. Typically, at least several drive ICs are therefore needed and the number of individual connections between these and the panel thin film circuitry, one for each IC output/column conductor, is considerable, for example 800 or more for a typical video/datagraphic display.

In accordance with an aspect of the present invention multiplexing is utilised to reduce the number of drive ICs required. The drive IC outputs are each multiplexed over a plurality of column conductors. As each drive IC output is then used to provide the data signals for a respective plurality of column conductors, the total number of outputs, and hence drive ICs, can be considerably reduced. For example, with a multiplexing ratio of 4:1 then only one quarter of the number of drive IC outputs previously required is needed, resulting in a cost saving of 75% for the drive ICs. The multiplexing circuit is integrated on the substrate, that is, fabricated on the substrate in similar manner to the pixel array using thin film technology. Such a circuit can readily be fabricated simultaneously with the pixel array using common deposited layers providing similar thin film circuit elements.

Figure 3:
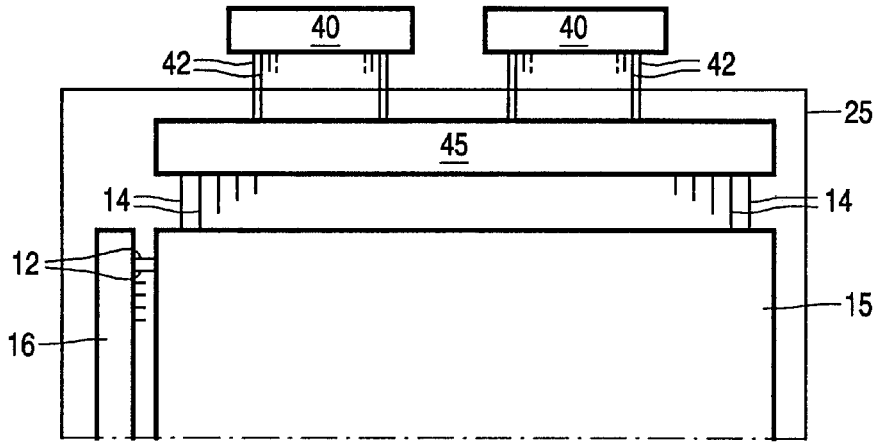
FIG. 3 shows schematically a part of an embodiment of display device according to the present invention including its column drive circuitry.

FIG. 3 illustrates schematically the basic arrangement in an embodiment of display device according to the invention. The pixel array carried on the substrate 25 is depicted generally here at 15. A number of drive IC chips 40, two in this example, are provided externally to the substrate 25, for generating and supplying data signals for the pixels at outputs thereof, with their individual output terminals, 41, from which the data signals are supplied, connected to inputs of a multiplexing circuit 45 integrated on the substrate 25. Assuming a drive IC has 100 outputs and, for example, there are 800 columns of pixels in the array and the multiplexing ratio of the circuit 45 is 4:1 so that each IC output provides the data signals for four columns, then only two drive ICs are used. Video information is supplied to the ICs 40 in generally conventional manner, for example in digital form, and the ICs operate to generate the analogue voltage data signals for the columns with which they are associated and to supply such to the relevant outputs 42.

The chips 40 can be provided in the device and interconnected with the thin film circuitry on the substrate 25 using, for example, COG or tab bonding technology known in the fabrication of other kinds of flat panel displays.

Figure 4:
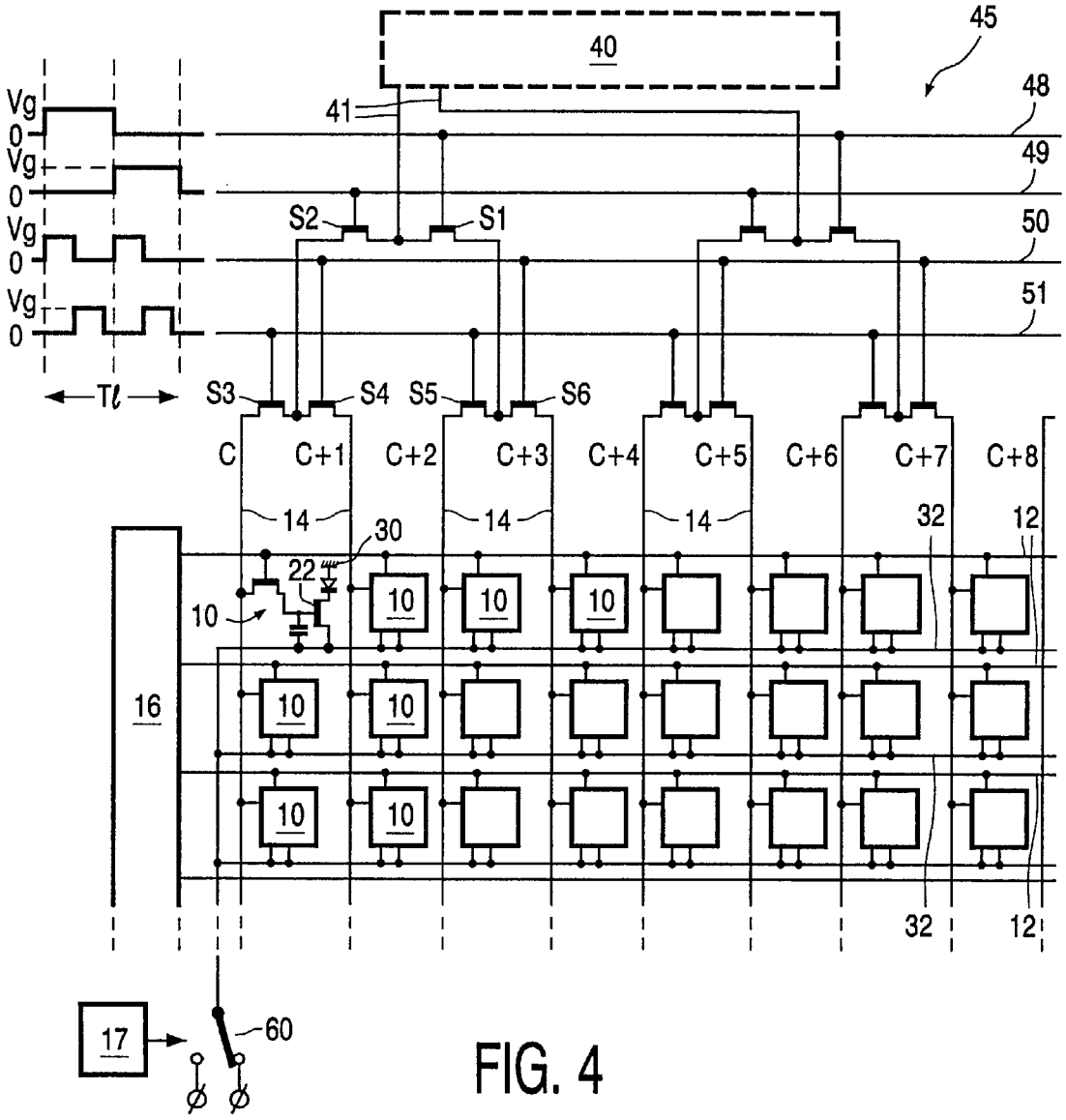
FIG. 4 shows a few typical pixels and associated part of the column drive circuitry in the embodiment of active matrix electroluminescent display device of FIG. 3 together with multiplexing drive waveforms present in operation of the device.

FIG. 4 illustrates in greater detail the nature of the multiplexing circuit 45. The figure shows a few typical pixels of the device and the associated part of the multiplexing circuit 45, together with example waveforms applied by the timing and control unit 17 in operation of this circuit. The pixel circuits are similar to those of FIG. 2, though other known kinds of pixels circuits could be used as well.

The columns of pixels 10 and their column conductors 14 are organised into groups of four, the eight consecutive column conductors, C to C+7, shown in FIG. 4 constituting two such groups. Each group of columns share the same, and respective, drive IC output 41, with the data signals for the pixels in these four columns being supplied by the one output 41.

The multiplexing circuit 45 comprises a set of four control signal bus lines, 48, 49, 50 and 51. Each group of four columns is connected to these bus lines via six multiplexer switches, comprising TFTs, labelled S1 to S6. Taking, for example, the first group comprising column conductors C to C+3, then these column conductors are connected respectively to the TFTs S3 to S6 with the gates of S3 and S5 being connected to the bus line 51 and the gates of S4 and S6 being connected to the bus line 50. Data signals are supplied to the pair of TFTs S3 and S4 and the pair of TFTs S5 and S6 respectively via the TFTs S2 and S1 whose gates are connected respectively to the bus lines 49 and 48.

The TFTs of a group are arranged to be operated in time division manner and in particular sequence in a row address period by means of control (gating) signals supplied to the bus lines, the corresponding TFTs in each of the other groups being operated simultaneously by the control signals. Example control signal waveforms for these bus lines are depicted adjacent their respective lines and comprise pulse signals effective to turn the TFTs on.

In the first half of a row address period, denoted by $T_L$, in which the pixels of a row are to be supplied with their data signals, a gating pulse signal occupying approximately one half of the row address period or less is supplied to the bus line 48 turning on TFT S1. During the duration of the application of this signal, gating signals are supplied in succession and separated in time, each occupying slightly less than one quarter of the row address period, to the bus lines 50 and 51 to turn on the TFTs S6 and S5 in succession. While TFT S6 is turned on a data signal for column conductor C+3 is supplied at the associated output 41 of the drive IC and fed via the TFT S1 and TFT S6 to that column. Similarly, while the TFT S5 is turned on, the drive IC is arranged to provide a data signal for the pixel connected to column conductor C+2 which is fed to that column conductor via TFTs S1 and S5. Thereafter, upon termination of the selection pulse signals applied to the bus lines 48 and 51 the potential of these lines drops to a low level, turning off the TFTs S5 and S1 and a selection (gating) signal is applied to the bus line 49 to turn on the TFT S2 for again approximately one half (the latter half) of the row address period. During this latter half of the row address period the TFTs S4 and S3 are similarly each turned on for slightly less than a quarter of the row address period in sequence by control signals on the bus lines 50 and 51 respectively so as to connect the column conductors C+1 and C in turn with the output 41 via the TFT S2. Whilst each TFT S4 and S3 is turned on, the appropriate data signals for the pixels in columns C and C+1 are supplied by the drive IC 40 to its output 41.

Thus each of the pixels in the group of four is supplied with a respective data signal in a respective row address sub-period, occupying approximately one quarter of the row address period. Corresponding pixels in all the other groups of a row, for example those associated with the column conductors C+4 to C+7, are addressed with their respective data signals, from their respective associated drive IC output 41, in the same period, with, for example, data signals being supplied simultaneously to columns C+7 and C+3, and data signals being supplied simultaneously to columns C+4 and C, etc. The chips therefore provide at each of their outputs a succession of discrete data signals for the columns with which they are associated in each row address period.

The particular arrangement shown in FIG. 4 is relatively simple and, of course, the number of column conductors in a group, and hence the multiplexing ratio, can be varied. For example, each group may comprise eight column conductors, resulting in an even greater reduction of the number of drive ICs required, but with a consequential reduction in the time allowed to supply each pixel in a group with its data signal.

It is also possible for the multiplexing circuit to be designed to provide different grouping arrangements such that the column conductors in the group are not necessarily consecutive, adjacent column conductors. For example, the column conductors of one group may comprise every third column conductor so that one group comprises column conductors C, C+3, and C+6, another group comprises C+1, C+4, and C+7, and a third group comprises C+2, C+5, and C+8.

The pixel TFTs and the multiplexing TFTs all comprise low temperature polysilicon TFTs. The TFTs used for the multiplexing switches S1 to S6 are of the same type as those used in the pixels 10, for example either n or p channel TFTs, (NMOS or PMOS). Fabrication of the pixel array and the integrated multiplexing circuit is then simplified compared with a situation requiring a CMOS circuit, with only 5 or 6 mask processes being required for the circuit fabrication unlike the 9 to 10 mask processes typically needed to form a CMOS circuit.

With the known kind of pixel circuit then during the addressing of a row of pixels, the drive TFTs 22 of the pixels can be turned on while the storage capacitor is charging. In order to avoid unwanted cross-talk effects due to voltage drops occurring along the current line 32 associated with a row of pixels during addressing of that row causing errors in the voltage stored on the storage capacitors of the pixels, and thus the cross-talk effect, then current flow through the display elements of the row is deliberately prevented while they are being addressed. In effect, a display element blanking period is introduced. As a consequence, the current line potential remains fixed at a certain level so that the pixel storage capacitors are all charged reliably to a respective desired level. More particularly, the current line is held at an appropriate potential, suitable to ensure that the display elements are zero or reverse biased, not just for the time in which the pixel concerned is actually being addressed but for the entire period during which the pixels of each of the groups in a row is being addressed, i.e. for the complete row address period. Such biasing is conveniently accomplished by switching the potential of the current line 32 between the level required during the driving phase, i.e the frame period between consecutive addressing phases, to the required level, for example the same potential as the common electrode 30, for the duration of the row addressing period though a switching device, shown at 60 in FIG. 4 and connected to all the current lines controlled by a control signal supplied by the timing and control unit 17 appropriately in synchronisation with the row selection signals. Instead, the potential of the common electrode 30 could be switched to the potential of the current line 32 to similar effect. In such case, the switching device 60 would be connected to the common electrode 30.

Alternatively, each pixel may be provided with an additional TFT switch connected in series with its display element, for example between the drive TFT 22 and the current supply line 32, whose operation is controlled by the selection signal applied to the relevant row address conductor 12 to prevent current flowing through the display element during the row address period As a consequence of the multiplexing column drive, the video information supplied to the drive ICs from which the individual data signals are derived will need to be sequenced differently to that normally used. Data would normally arrive in the following order: C, C+1, C+2, . . . C+7, etc. When using 4:1 multiplexing it is appropriately re-ordered to arrive in the following sequence: C, C+4, C+8, . . . C+1, C+5, C+9, . . . , C+2, C+6, C+10 . . . C+3, C+7, C+11, . . . etc.

The row drive circuit 16, comprising a shift register circuit, may also be integrated on the substrate 25 and fabricated simultaneously with the pixel array 15 and the multiplexing circuit 45, as shown in FIG. 3. Like the column drive arrangement, the row selection circuit may similarly use multiplexing to similar benefit. Although as previously mentioned it is preferred that the TFTs used in the pixel circuits and the integrated multiplexing circuit 45 are all of the same type, i.e. either p or n channel TFTs, it is envisaged that the device could use both types. This would enable circuits requiring CMOS circuitry such as shift registers also to be fully integrated on the substrate 25. A shift register circuit can be used as part of the column drive circuit or, as previously mentioned, the row drive (selection) circuit.

Although a particular pixel circuit is used in the above-described embodiment, it will be appreciated that other kinds of pixel circuits suitable for active matrix addressing could be used, as will be apparent to persons skilled in the art.

From reading the present disclosure, other modifications will be apparent to persons skilled in the art. Such modifications may involve other features which are already known in the field of active matrix electroluminescent display devices and component parts thereof and which may be used instead of or in addition to features already described herein.

What is claimed is:

1. An active matrix electroluminescent display device comprising:

a row and column array of pixels carried on a substrate, each pixel comprising an elecroluminescent display element and a driving device for controlling current through the display element in a drive period based on a data signal applied in a preceding row address period, the display element being connected via the driving device to a current line common to a row of pixels, and a peripheral drive circuit connected to the pixel array which drive circuit generates and applies data signals to each row of pixels in respective row address periods via a set of column address conductors connected to the array of pixels and comprises at least one drive IC having a plurality of outputs, characterized in that the at least one drive IC is connected to the set of address conductors through a multiplexing circuit which is integrated on the substrate and applies data signals from each output of the drive IC to a respective plurality of address conductors in the set in sequence in the row address period, and the drive circuit is arranged to prevent current flowing through the display elements of a row of pixels during its respective row address period.

2. An active matrix electroluminescent display device according to claim 1, characterized in that the address conductors of the one set are organized in groups with each group being associated with a respective drive IC output, the multiplexing circuit comprising switching devices supplying data signals from an output to each of the address conductors of its associated group in turn in the same period.

3. An active matrix electroluminescent display device according to claim 2, characterized in that the drive devices of the pixels and the switching devices of the multiplexing circuit all comprise either p or n channel TFTs.

4. An active matrix electroluminescent display device according to claim 2, characterized in that the drive devices of the pixels and the switching devices of the multiplexing circuit comprise both p and n channel TFTs.

5. An active matrix electroluminescent display device according to claim 4, characterized in that the peripheral drive circuit further includes a shift register circuit integrated on the substrate and comprising p and n channel TFTs.

6. An active matrix electroluminescent display device according to claim 1, characterized in that the drive circuit is arranged to switch the potential applied to be common current line for the respective address period.

7. An active matrix electroluminescent display device according to claim 1, characterized in that:

the display element of a pixel is connected to its associated current line through a switching device; and the drive circuit is arranged to operate the switching device to isolate the display element from the current line for the duration of the row address period.

8. An active matrix electroluminescent display device according to claim 1, characterized in that a magnitude of a data signal applied to a pixel through a respective multiplexing circuit represents a luminance level for the succeeding drive period.

9. An active matrix electroluminescent display device according to claim 2, characterized in that the drive circuit is arranged to switch the potential applied to the common current line for the respective address period.

10. An active matrix electroluminescent display device according to claim 2, characterized in that:

the display element of a pixel is connected to its associated current line through a switching device; and the drive circuit is arranged to operate the switching device to isolate the display element from the current line for the duration of the row address period.

11. An active matrix electroluminescent display device according to claim 2, characterized in that a magnitude of a data signal applied to a pixel through a respective multiplexing circuit represents a luminance level for the succeeding drive period.

12. An active matrix electroluminescent display device according to claim 11, characterized in that the drive circuit is arranged to switch the potential applied to the common current line for the respective address period.

13. An active matrix electroluminescent display device according to claim 11, characterized in that:

the display element of a pixel is connected to its associated current line through a switching device; and the drive circuit is arranged to operate the switching device to isolate the display element from the current line for the duration of the row address period.

14. An active matrix electroluminescent display device according to claim 11, characterized in that the drive devices of the pixels and the switching devices of the multiplexing circuit all comprise TFTs of a same channel type.

15. An active matrix electroluminescent display device according to claim 14, characterized in that the drive circuit is arranged to switch the potential applied to the common current line for the respective address period.

16. An active matrix electroluminescent display device according to claim 14, characterized in that:

the display element of a pixel is connected to its associated current line through a switching device; and the drive circuit is arranged-to operate the switching device to isolate the display element from the current line for the duration of the row address period.

17. An active matrix electroluminescent display device according to claim 11, characterized in that the drive devices of the pixels and the switching devices of the multiplexing circuit comprise both p and n channel TFTs.

18. An active matrix electroluminescent display device according to claim 17, characterized in that the peripheral drive circuit further includes a shift register circuit integrated on the substrate and comprising p and n channel TFTs.

19. An active matrix electroluminescent display device according to claim 18, characterized in that the drive circuit is arranged to switch the potential applied to the common current line for the respective address period.

20. An active matrix electroluminescent display device according to claim 18, characterized in that:

the display element of a pixel is connected to its associated current line through a switching device; and the drive circuit is arranged to operate the switching device to isolate the display element from the current line for the duration of the row address period.

* * * * *